US008186906B2

(12) United States Patent
Zimmerman

(10) Patent No.: US 8,186,906 B2
(45) Date of Patent: May 29, 2012

(54) SCREED MACHINE FOR PREPARING A STONE BASE

(75) Inventor: Melvin M. Zimmerman, Denver, PA (US)

(73) Assignee: SWA Holding Company, Inc., Wilmington, DE (US)

( * ) Notice: Subject to any disclaimer, the term of this patent is extended or adjusted under 35 U.S.C. 154(b) by 125 days.

(21) Appl. No.: 12/794,523

(22) Filed: Jun. 4, 2010

(65) Prior Publication Data

US 2010/0307103 A1 Dec. 9, 2010

Related U.S. Application Data

(60) Provisional application No. 61/184,350, filed on Jun. 5, 2010.

(51) Int. Cl.
*E01C 19/23* (2006.01)

(52) U.S. Cl. ..... 404/75; 404/117; 404/118

(58) Field of Classification Search ..... 404/84.05–85, 404/101, 103, 117, 118, 131–133.1
See application file for complete search history.

(56) References Cited

U.S. PATENT DOCUMENTS 2,065,698 A * 12/1936 Heltzel ..... 404/101
4,358,123 A * 11/1982 Richards ..... 280/47.131
4,614,486 A * 9/1986 Bragagnini ..... 425/62
4,712,943 A * 12/1987 Alvarsson ..... 404/75
5,062,738 A * 11/1991 Owens ..... 404/114
5,567,075 A * 10/1996 Allen ..... 404/84.5
5,803,656 A * 9/1998 Turck ..... 404/103
6,022,171 A * 2/2000 Munoz ..... 404/124
6,758,631 B2 * 7/2004 Frankeny, II ..... 404/118
6,837,648 B1 * 1/2005 Wadensten ..... 404/117
7,121,762 B2 * 10/2006 Quenzi et al. ..... 404/84.1
7,530,203 B1 5/2009 Hare ..... 52/251
2002/0090263 A1 * 7/2002 Garrity, Jr. ..... 404/101
2002/0192026 A1 * 12/2002 Somero et al. ..... 404/118

* cited by examiner

*Primary Examiner* — Raymond W Addie
(74) *Attorney, Agent, or Firm* — Miller Law Group, PLLC

(57) ABSTRACT

A screed machine is formed with a forwardly positioned screed assembly including a wedge portion and pivoted wing members. The frame is supported on two rollers spaced behind the screed assembly, which is mounted on a mast for vertical movement in conjunction with a laser receiver that provides a signal from a laser level indicating the final desired grade of the stone base. The machine can be turned at a corner by extension of a jack stand to elevate the machine for rotation about the axis defined by the centrally located jack stand so that the screed machine can be redirected into a different direction without disturbing the final grade of the stone base. The screed machine is manually moved along the stone base by an operator pulling on the handle pivotally connected to the frame. A sight line provides a monitor for the lateral orientation of the screed assembly.

15 Claims, 16 Drawing Sheets

SCREED MACHINE FOR PREPARING A STONE BASE

CROSS-REFERENCE TO RELATED APPLICATIONS

This application claims domestic priority on U.S. Provisional Patent Application Ser. No. 61/184,350, filed on Jun. 5, 2010, the content of which is incorporated herein by reference.

FIELD OF THE INVENTION

The present invention generally relates to an apparatus for preparing a stone base for subsequent construction and, more particularly, to a screed machine that will level a stone base for the installation of a pre-cast concrete wall.

BACKGROUND OF THE INVENTION

Construction of a large number of structures, including buildings, sewer lines, prefabricated structures, etc., begins with the placement of a stone base. In some instances, the stone base must be accurately placed and graded for the proper construction of the structure. For example, a gravity sewer line is constructed at a sloped grade under which the stone base is graded at that same slope to provide proper support for the sewer line. Another example of a stone base that requires precise grading is the stone base under a pre-cast concrete wall.

A pre-cast concrete wall is manufactured at a remote site and shipped to the job site to be erected. A pre-cast concrete wall, constructed as disclosed, for example, in U.S. Pat. No. 7,530,203, granted on May 12, 2009, to Robert W. Hare, et al., is formed with a footer beam that is placed on a graded stone base. A plurality of the pre-cast concrete wall panels are placed around the pre-graded stone base to form an enclosed foundation for a building to be subsequently built on the foundation. The proper support of the footer beams requires that the stone base beneath the pre-cast concrete walls is graded level in both longitudinal and transverse directions so that the stone will contact the underside of the footer beam all along the erected foundation.

Conventionally, the grading of the stone base is first rough graded to within about an inch of being level around the location for the erection of the pre-cast concrete walls. Final grading is accomplished by first setting grading monuments, such as a piece of a wooden two by four placed into the stone base, around the perimeter of the foundation to be erected and then leveled at the desired elevation by a laser level. The stone base can then be hand graded by sliding a screed between consecutive monuments so that the stone base between the monuments is at the same elevation as the adjacent monuments. This process is repeated around the perimeter of the foundation until the entire area on which the pre-cast concrete walls are to be erected is leveled at the desired grade elevation. This process is extremely time consuming and labor intensive.

Accordingly, it would be desirable to provide an apparatus that would be operable to grade a stone base accurately and uniformly without requiring the setting of elevation monuments and hand screeding to accomplish the graded stone base.

SUMMARY OF THE INVENTION

It is an object of this invention to overcome the aforementioned disadvantages of the known prior art by providing a manually operated screed machine for leveling a stone base for the installation of pre-cast concrete walls.

It is another object to provide a screed assembly that is vertically movable relative to ground support members to maintain a selected grade elevation for the stone base as the screed machine is moved along the stone base where the pre-cast concrete walls are to be positioned.

It is a feature of this invention that the screed assembly is mounted on a telescopic mast that is operably connected to an actuator to affect vertical movement of the screed assembly.

It is an advantage of this invention that the actuator can be electronically coupled to a laser receiver to affect movement of the screed assembly in conjunction with a laser level defining the final grade for the stone base.

It is another feature of this invention that the screed machine is supported on the ground by a pair of longitudinally spaced rollers.

It is another advantage of this invention that the rollers allow the screed machine to be moved over the stone base.

It is still another advantage of this invention that the screed assembly is positioned in front of the forwardmost roller so that the rollers are supporting the screed machine on the final grade of the stone base.

It is still another feature of this invention that the screed assembly is formed with a forwardly projecting wedge portion that sweeps excess stone base laterally as the screed machine is moved forwardly over the stone base.

It is yet another feature of this invention that the screed assembly is formed with a pair of laterally extending wings that project in opposing directions from the wedge portion to deflect stone base material laterally away from the rollers.

It is yet another advantage of this invention that each of the wings is mounted on a pivot to permit a positioning of the wings in selective angular orientations relative to the wedge portion.

It is still another advantage of this invention that the rollers compact the leveled stone base after the stone base is leveled by the screed assembly.

It is still another object of this invention to provide a method of fine grading a stone base to prepare for the installation of pre-cast concrete walls on the stone base.

It is a further feature of this invention that the stone base is rough graded before the screed machine is placed on the stone base.

It is still a further feature of this invention that the screed machine is pulled along a path on the stone base corresponding to the location along which the pre-cast concrete wall panels are to be installed.

It is a further advantage of this invention that the final grade is set on a laser level with the signal therefrom being received on the screed machine to cause vertical adjustment of the position of the screed assembly.

It is yet another object of this invention to provide a pivot mechanism to allow the screed machine to turn corners on the stone base without disturbing the final grade thereof.

It is still another feature of this invention that the frame of the screed machine supports a jack stand that is selectively positionable into engagement with the stone base to allow the screed machine to be lifted above the stone base and rotated to change directions for the movement thereof.

It is still another advantage of this invention that the jack stand is positioned at approximately the center of gravity of the screed machine so that the entire screed machine can be balanced on the jack stand for rotation about the axis corresponding to the jack stand.

It is yet another advantage of this invention that the extension of the jack stand is powered by an actuator.

It is still another object of this invention to provide a monitor to indicate the lateral inclination of the screed machine.

It is another feature of this invention that the lateral level monitor includes a sight level mounted the mast of the screed machine.

It is yet another feature of this invention that the frame of the screed machine is provided with a handle assembly that allows an operator to manually pull the screed machine along the desired path on the stone base.

It is a further feature of this invention that all of the actuators on the screed machine are electrically powered from a battery supported on the screed machine.

It is yet another object of this invention to provide a screed machine for leveling a stone base that is durable in construction, inexpensive of manufacture, carefree of maintenance, facile in assemblage, and simple and effective in use.

These and other objects, features and advantages are accomplished according to the instant invention by providing a screed machine having a forwardly positioned screed assembly including a wedge portion and pivoted wing members. The frame is supported on two rollers longitudinally spaced behind the screed assembly. The screed assembly is mounted on a mast for vertical movement in conjunction with a laser receiver that provides a signal indicating the final desired grade of the stone base. The machine can be turned at a corner by extension of a jack stand to elevate the entire machine for rotation about the axis defined by the centrally located jack stand so that the screed machine can be redirected into a different direction without disturbing the final grade of the stone base. The screed machine is manually moved along the stone base by an operator pulling on the handle pivotally connected to the frame. A sight level provides a monitor for the lateral orientation of the screed assembly.

BRIEF DESCRIPTION OF THE DRAWINGS

The advantages of this invention will be apparent upon consideration of the following detailed disclosure of the invention, especially when taken in conjunction with the accompanying drawings wherein.

DETAILED DESCRIPTION OF THE PREFERRED EMBODIMENT

Figure 1:
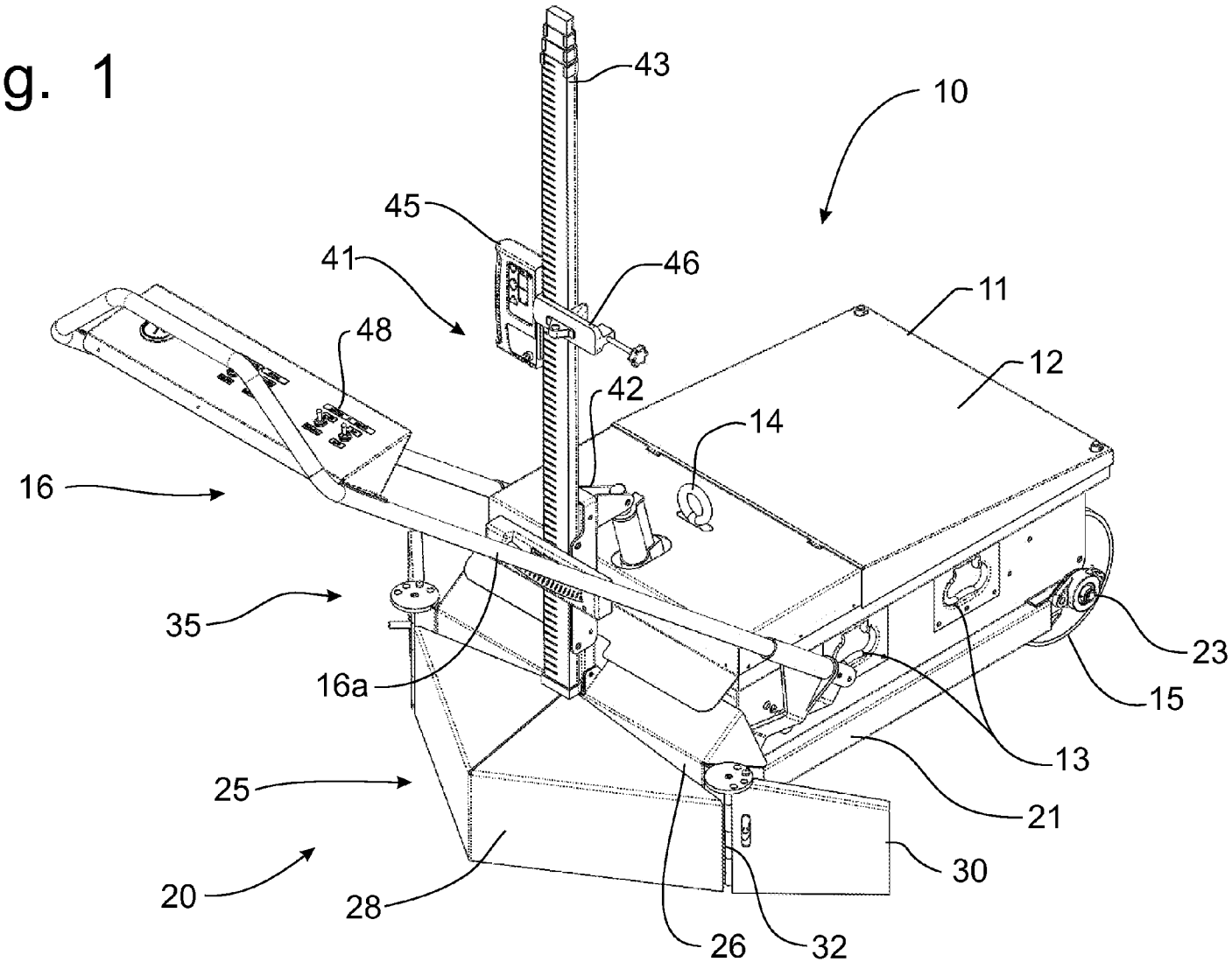
FIG. 1 is an upper, left front perspective view of the screed machine incorporating the instant invention, the wings being pivoted outwardly to widen the screed width of the apparatus.
Figure 2:
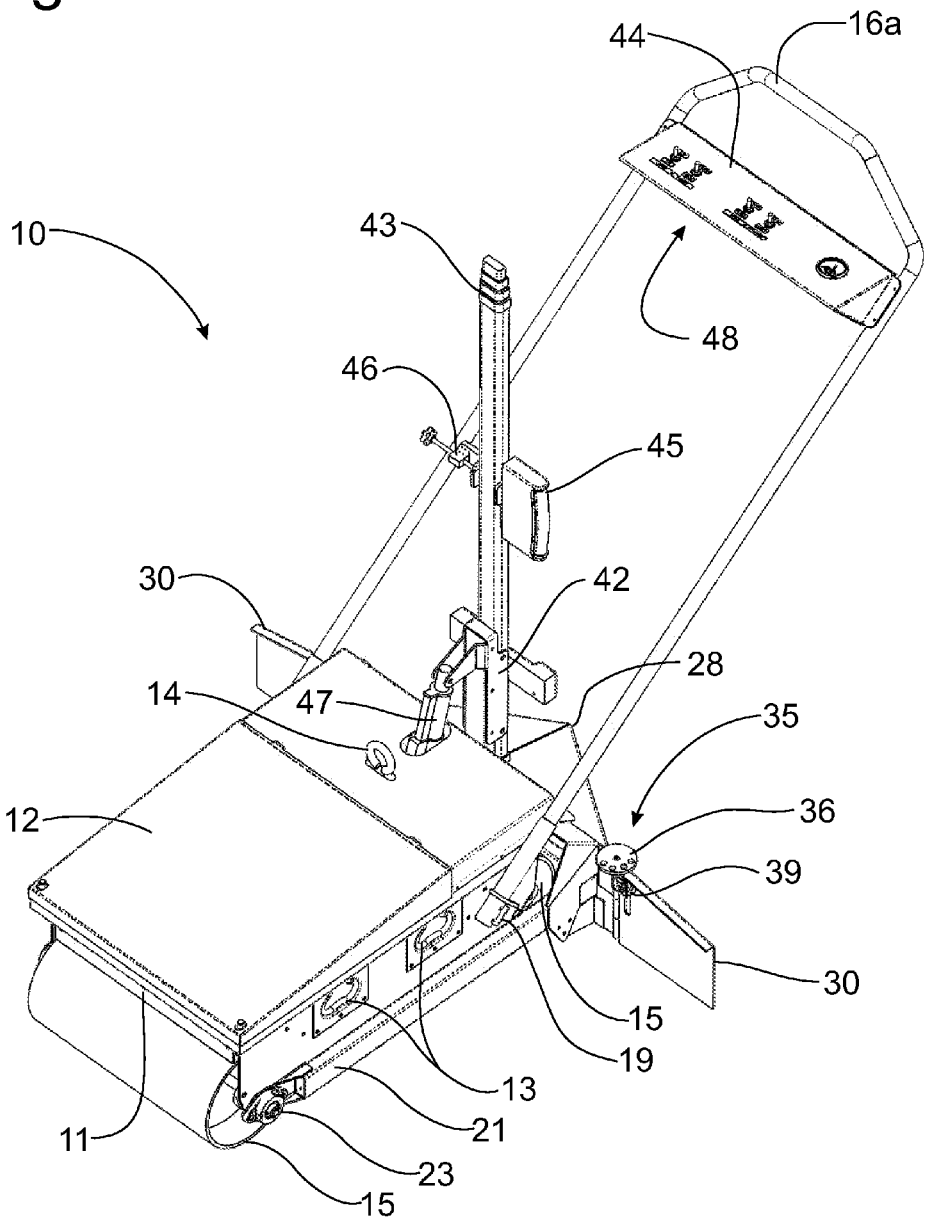
FIG. 2 is an upper, right rear perspective view of the screed machine shown in FIG. 1.

Referring to FIGS. 1-16, a screed machine incorporating the principles of the instant invention can best be seen. Left, right, front and rear references are use as a matter of convenience and are determined by standing at the rear of the machine 10 and facing the handle assembly 16 mounted at the forward end to pull the machine 10 along a direction of operative travel. The screed machine 10 has a generally rectangular main frame 11 having a central transverse cross member 11*a*. The main frame 11 rotatably supports a pair of longitudinally spaced, transversely extending rollers 15 that engage the surface of the stone base to compact and smooth the surface being leveled, as will be discussed in greater detail below. The main frame 11 has a pair of grips 13 located on each transverse side of the frame to provide an apparatus on which people can grasp to push the screed machine 10 when necessary. The main frame 11 also includes a crane hoist 14 centrally located on the main frame 11 so that a crane can be attached to the main frame 11 to lift the machine 10 into and out of a foundation excavation. Preferably, a removable or hinged cover plate 12 is mounted on top of the frame 11 to shield the operative devices described in greater detail below.

Figure 3:
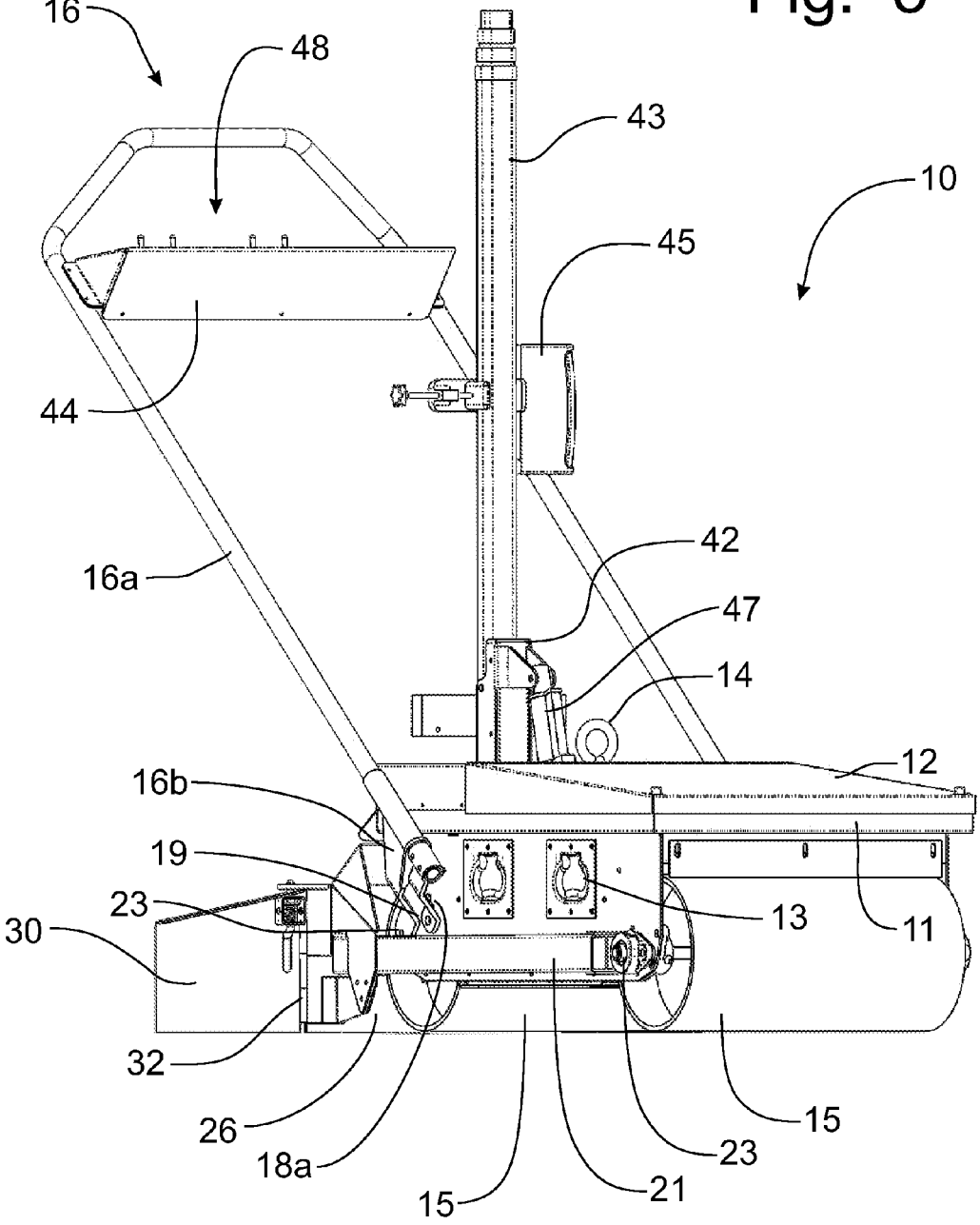
FIG. 3 is a left rear perspective view of the screed machine shown in FIG. 1.
Figure 4:
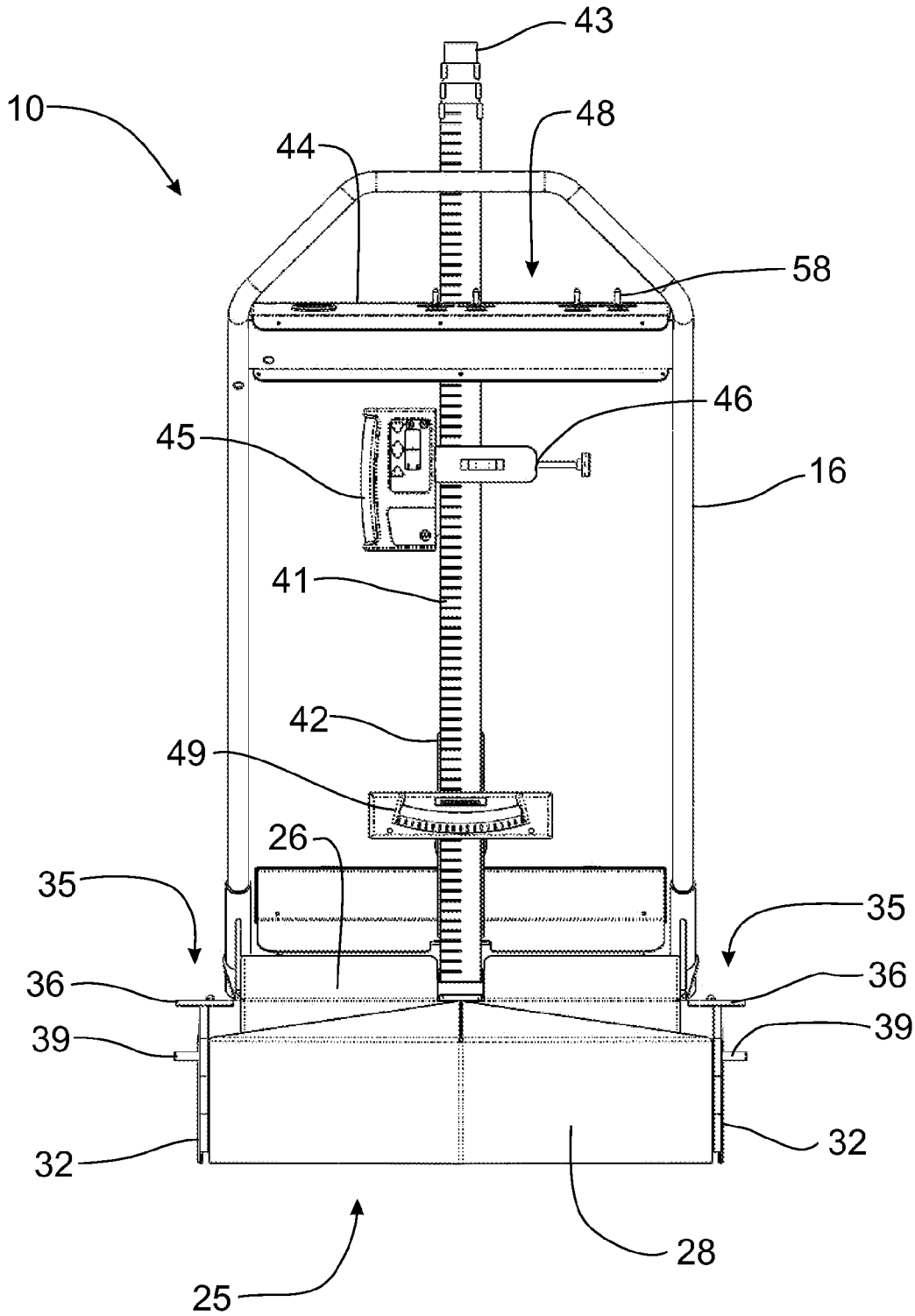
FIG. 4 is a front elevational view of the screed machine having the wings pivoted inwardly to a non-operational position.
Figure 5:
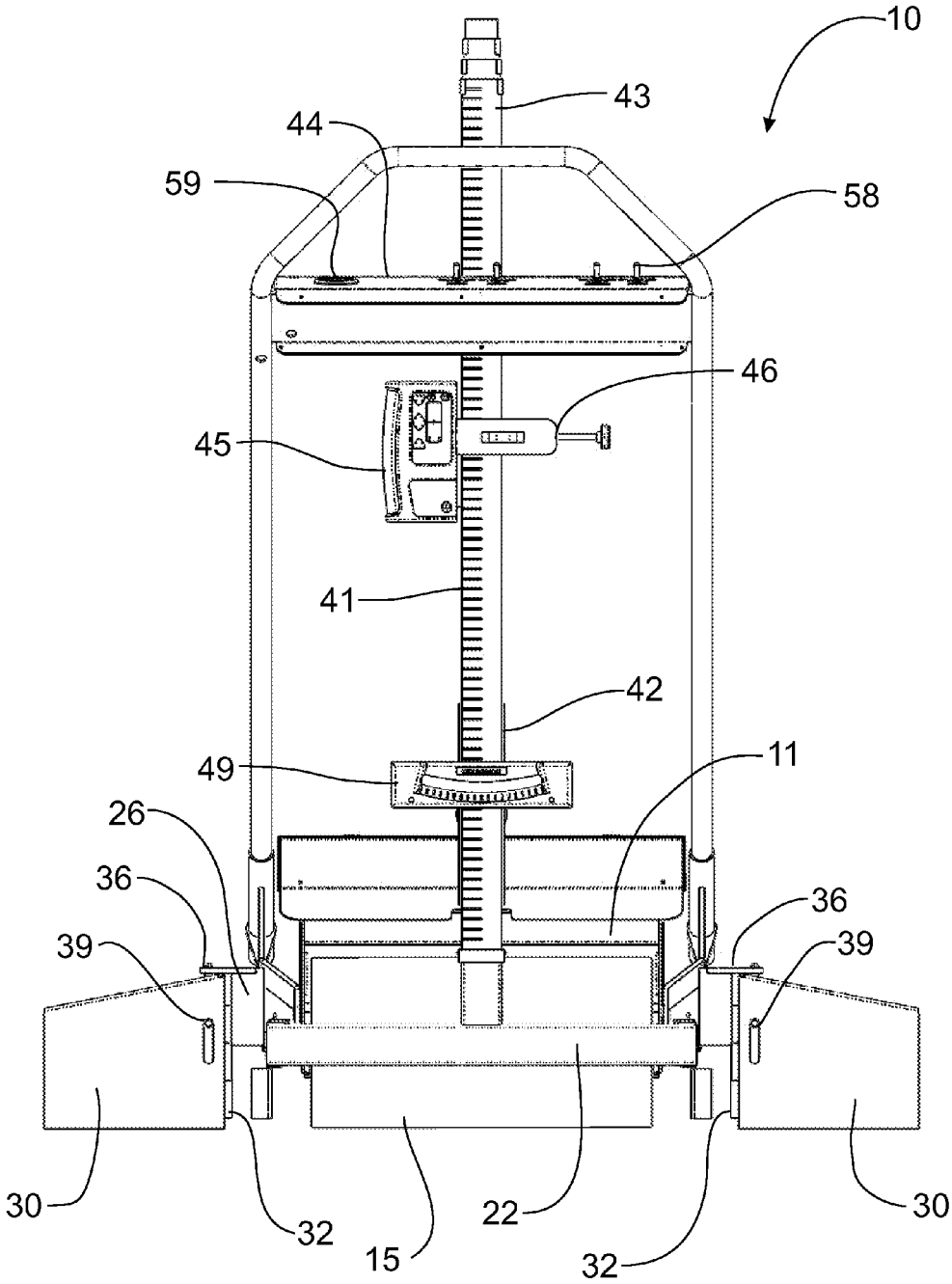
FIG. 5 is a front elevational view of the screed machine similar to that of FIG. 4, but having the screed broken away to view the structure at the front of the apparatus, the wings being pivoted outwardly.
Figure 6:
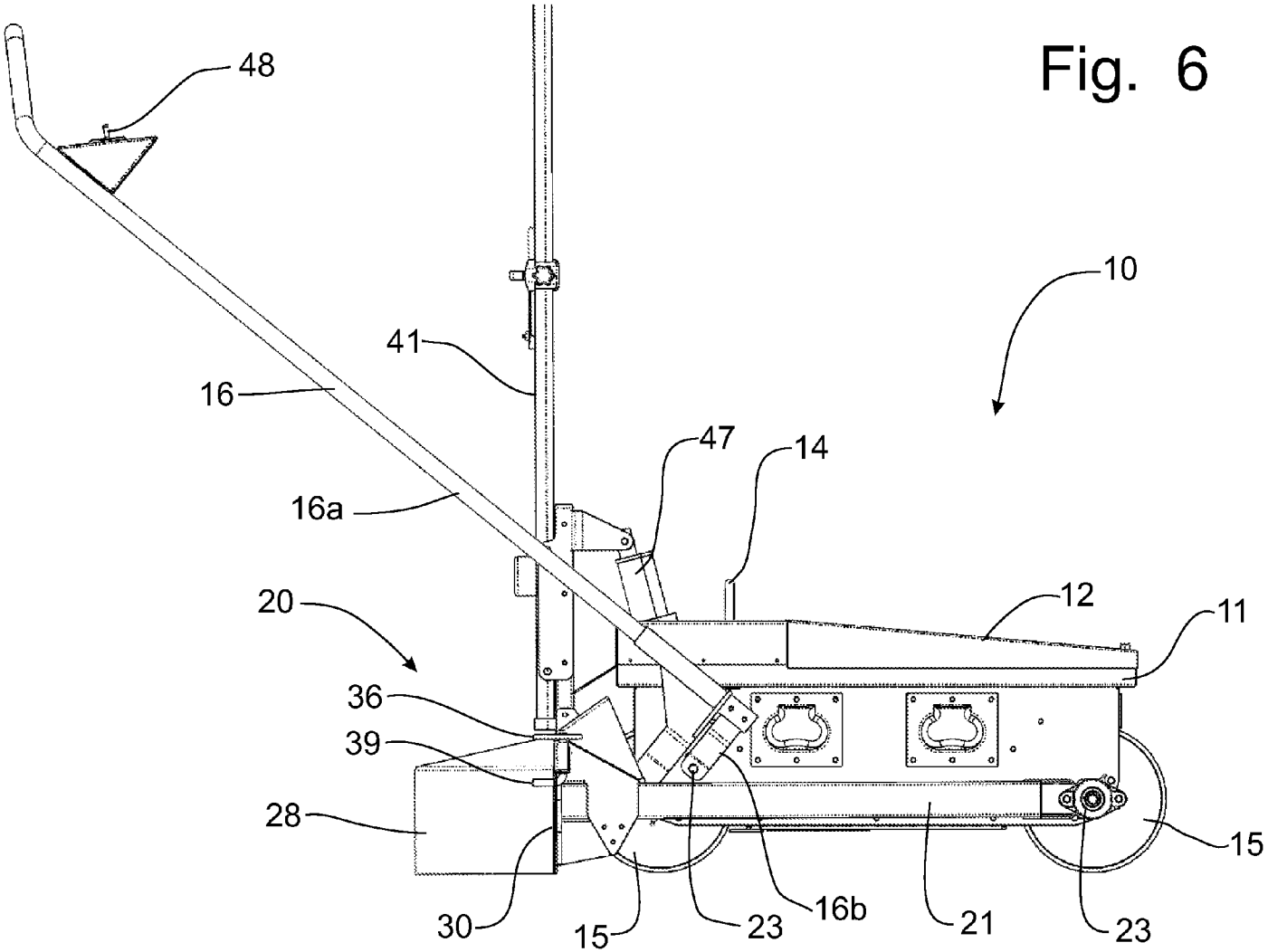
FIG. 6 is a left side elevational view of the screed machine having the wings pivoted outwardly.
Figure 7:
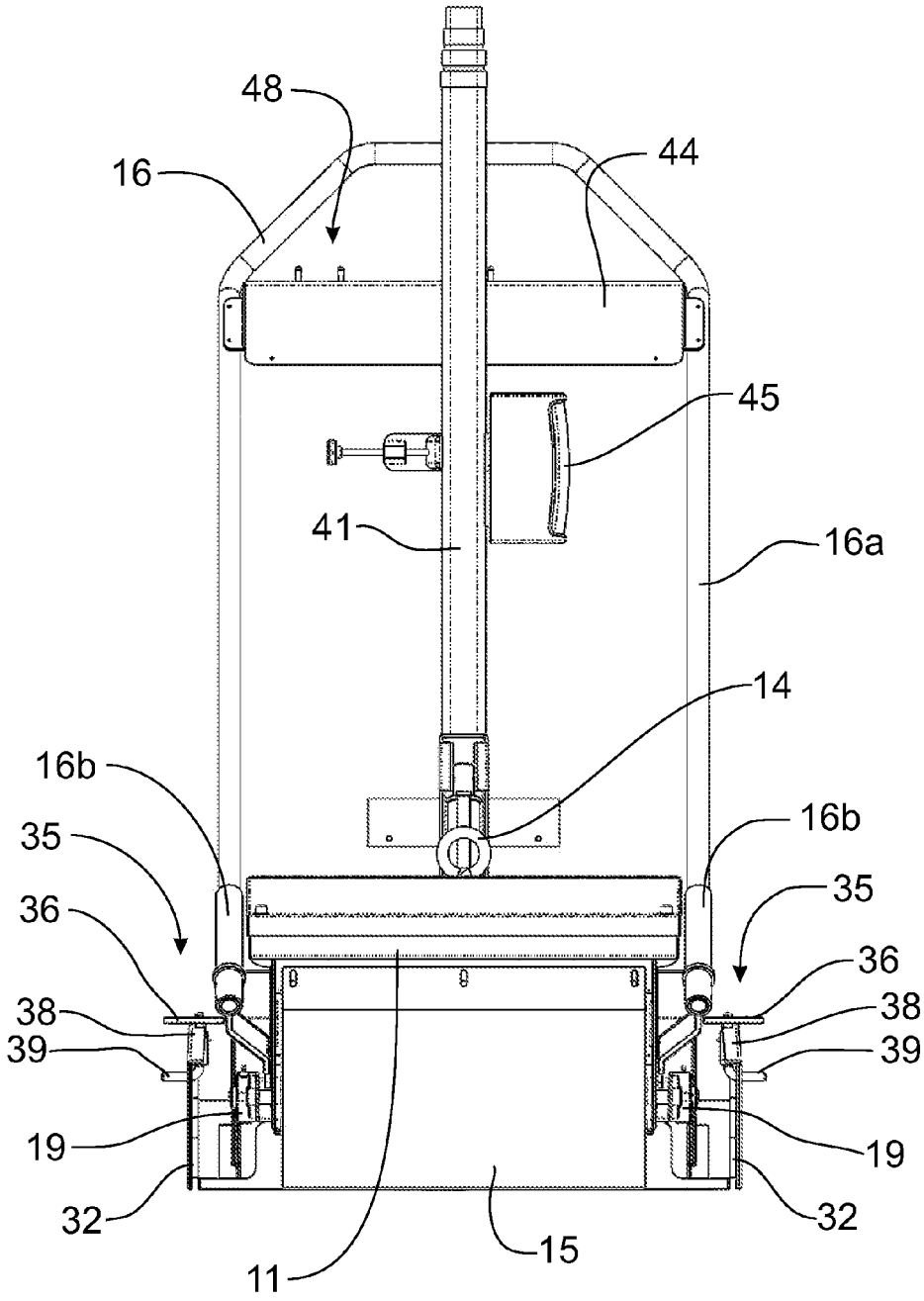
FIG. 7 is a rear elevational view of the screed machine, the wings being pivoted inwardly to a non-operative position.
Figure 8:
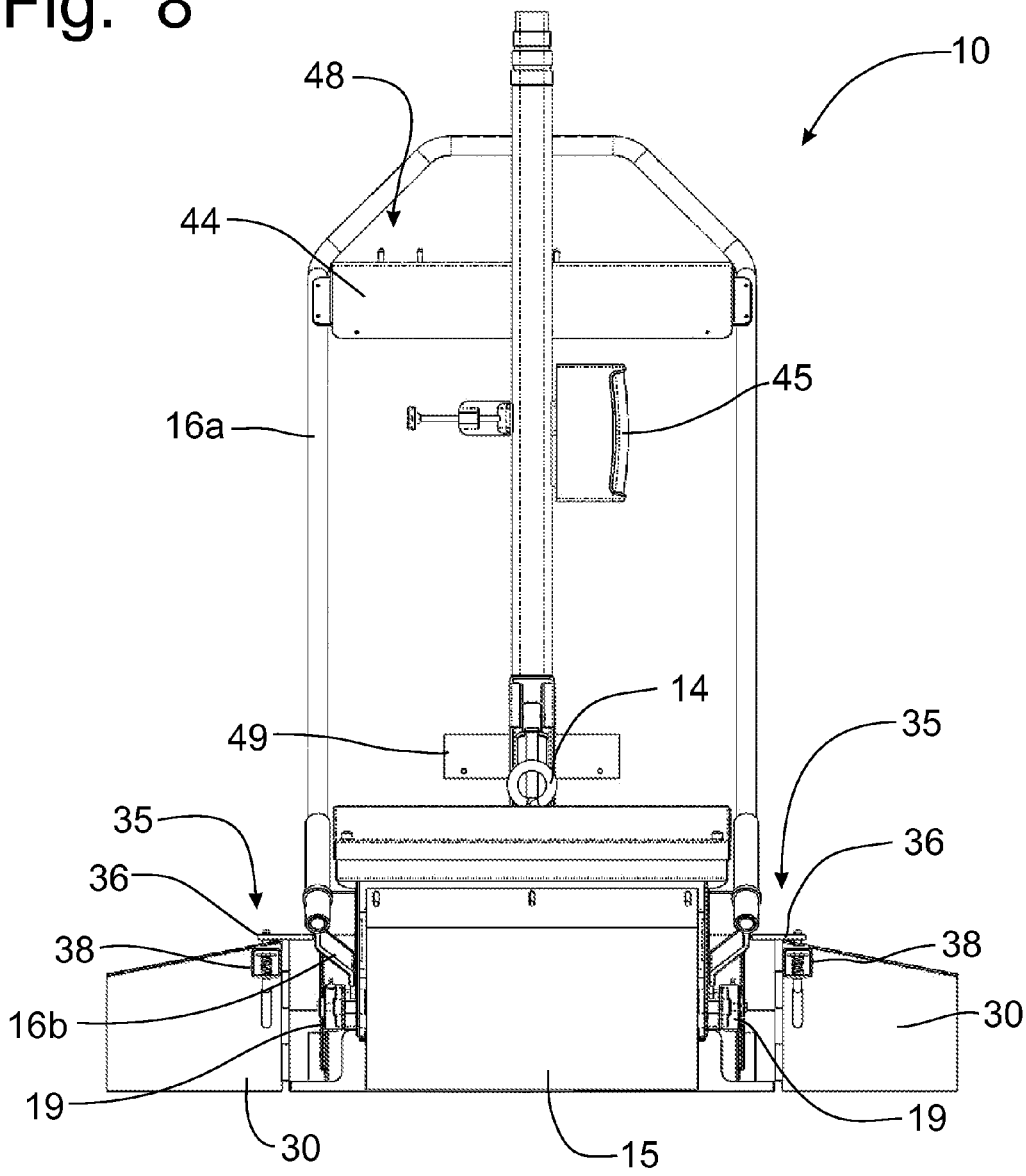
FIG. 8 is a rear elevational view of the screed machine similar to that of FIG. 7, but having the wings pivoted outwardly.
Figure 9:
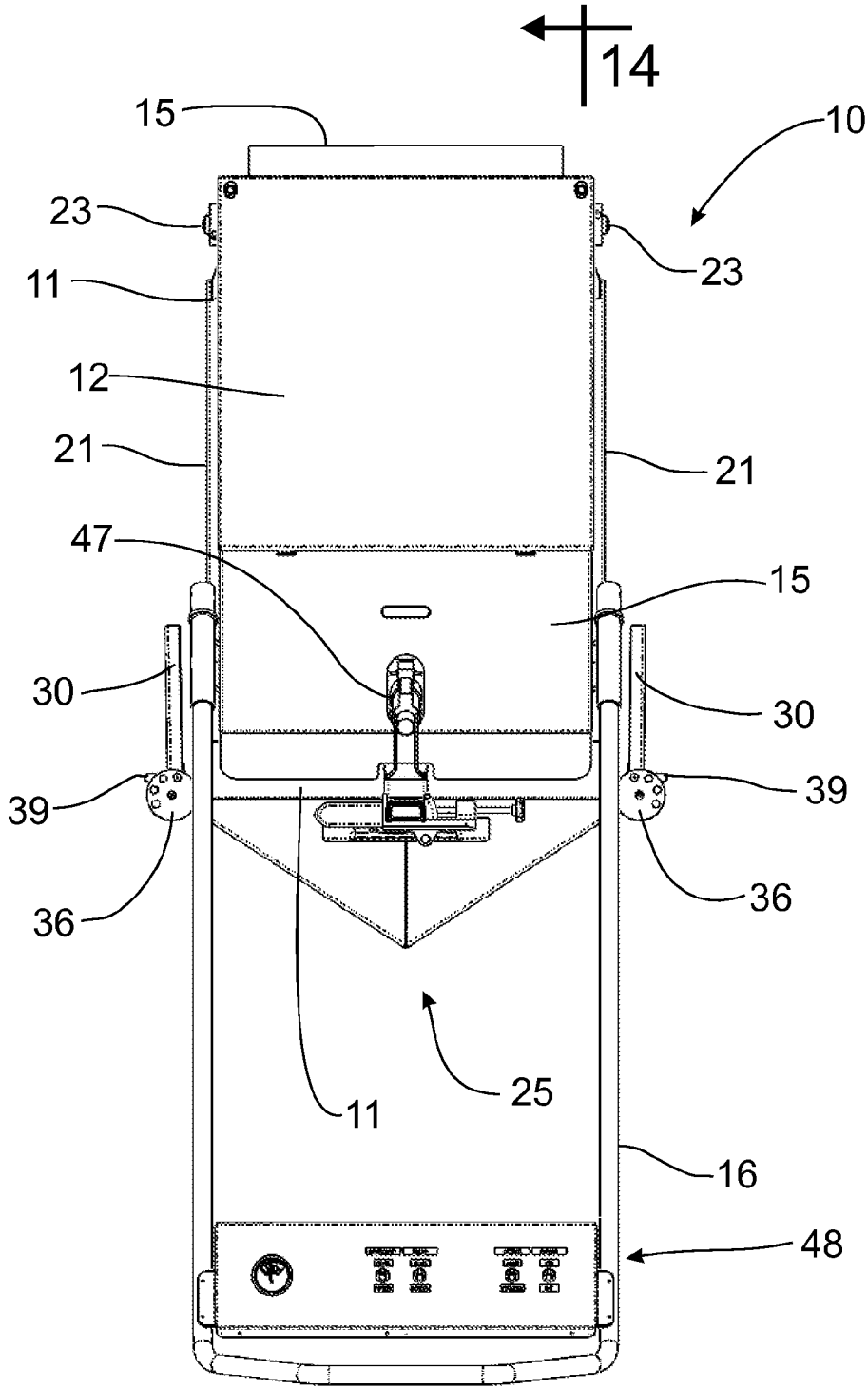
FIG. 9 is a top plan view of the screed machine having the wings pivoted inwardly.
Figure 10:
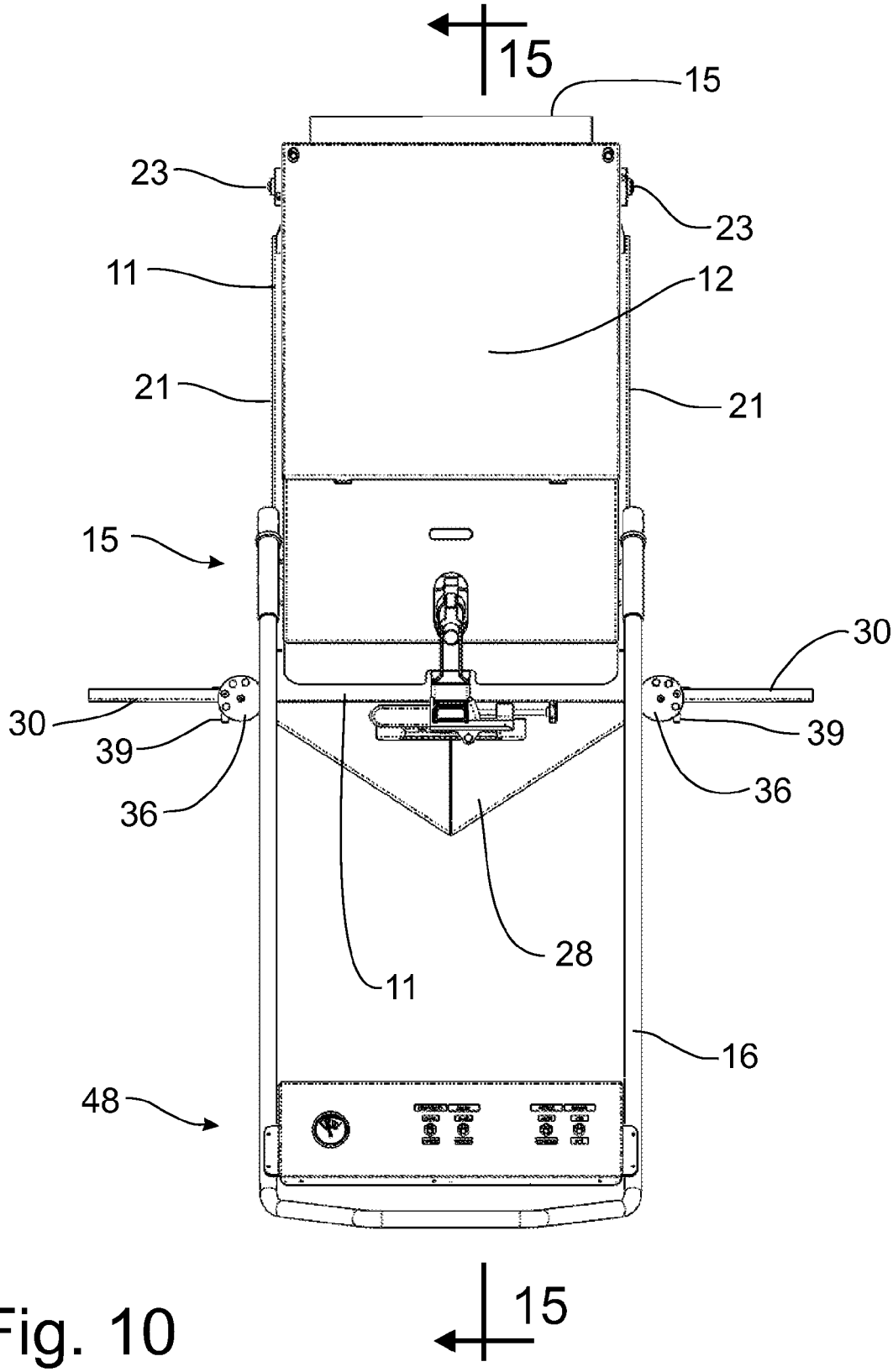
FIG. 10 is a top plan view of the screed machine similar to that of FIG. 9, but having the wings pivoted outwardly.
Figure 11:
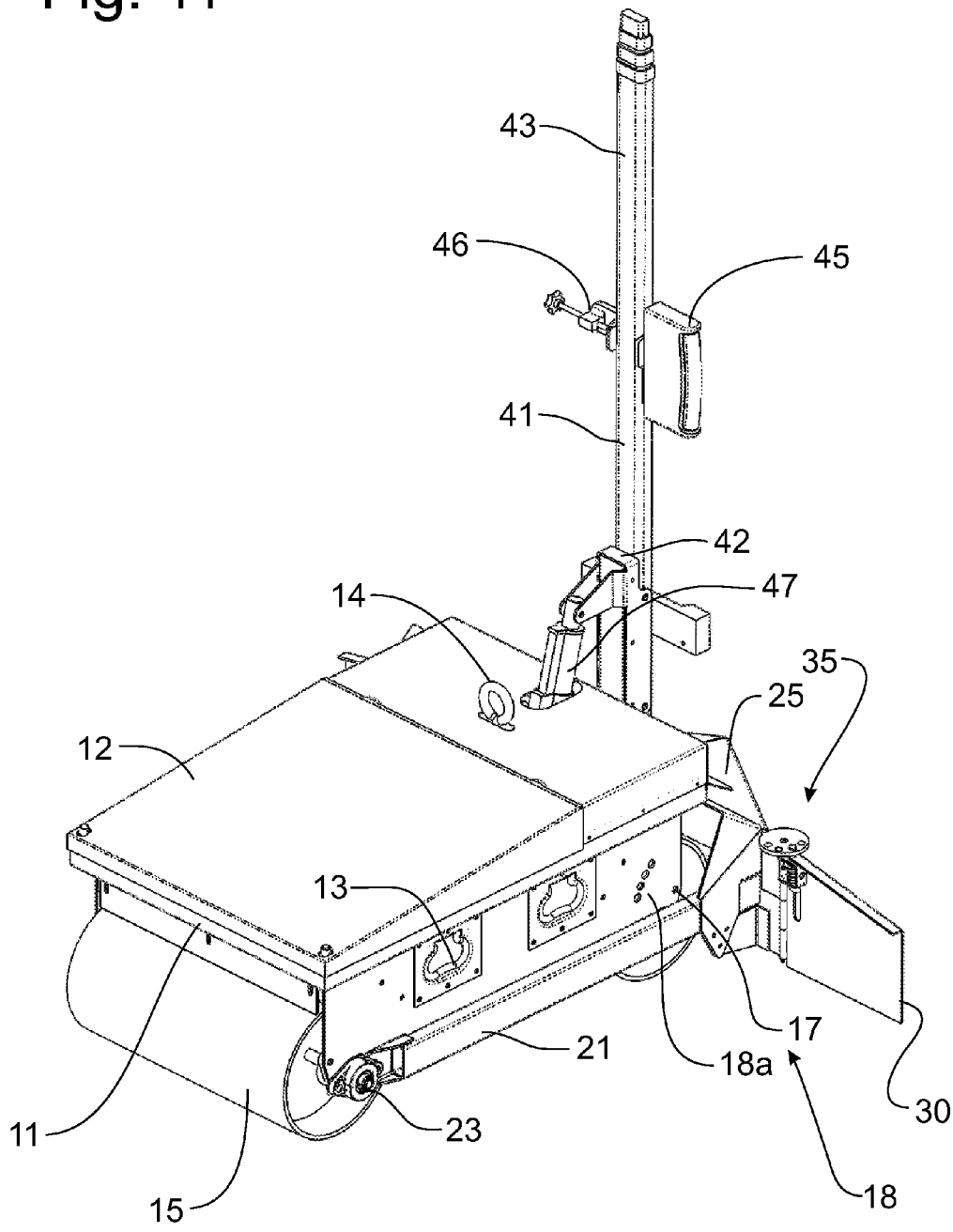
FIG. 11 is a right rear perspective view of the screed machine with the handle being broken away to better view the frame components of the apparatus, the wings being pivoted outwardly.
Figure 12:
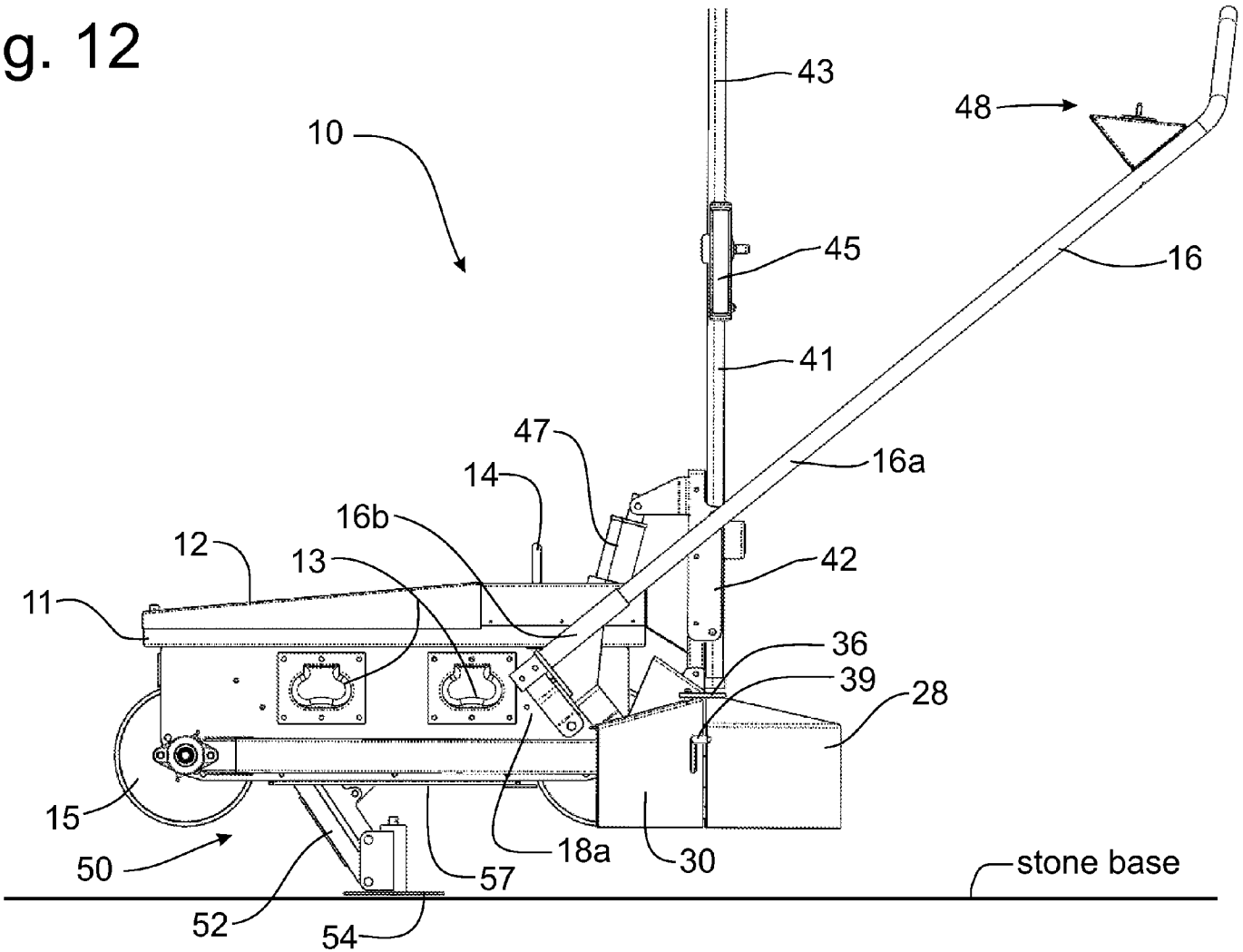
FIG. 12 is a right side elevational view of the screed machine having the wings pivoted outwardly and the central support jack extended to allow the screed machine to make a turn.
Figure 13:
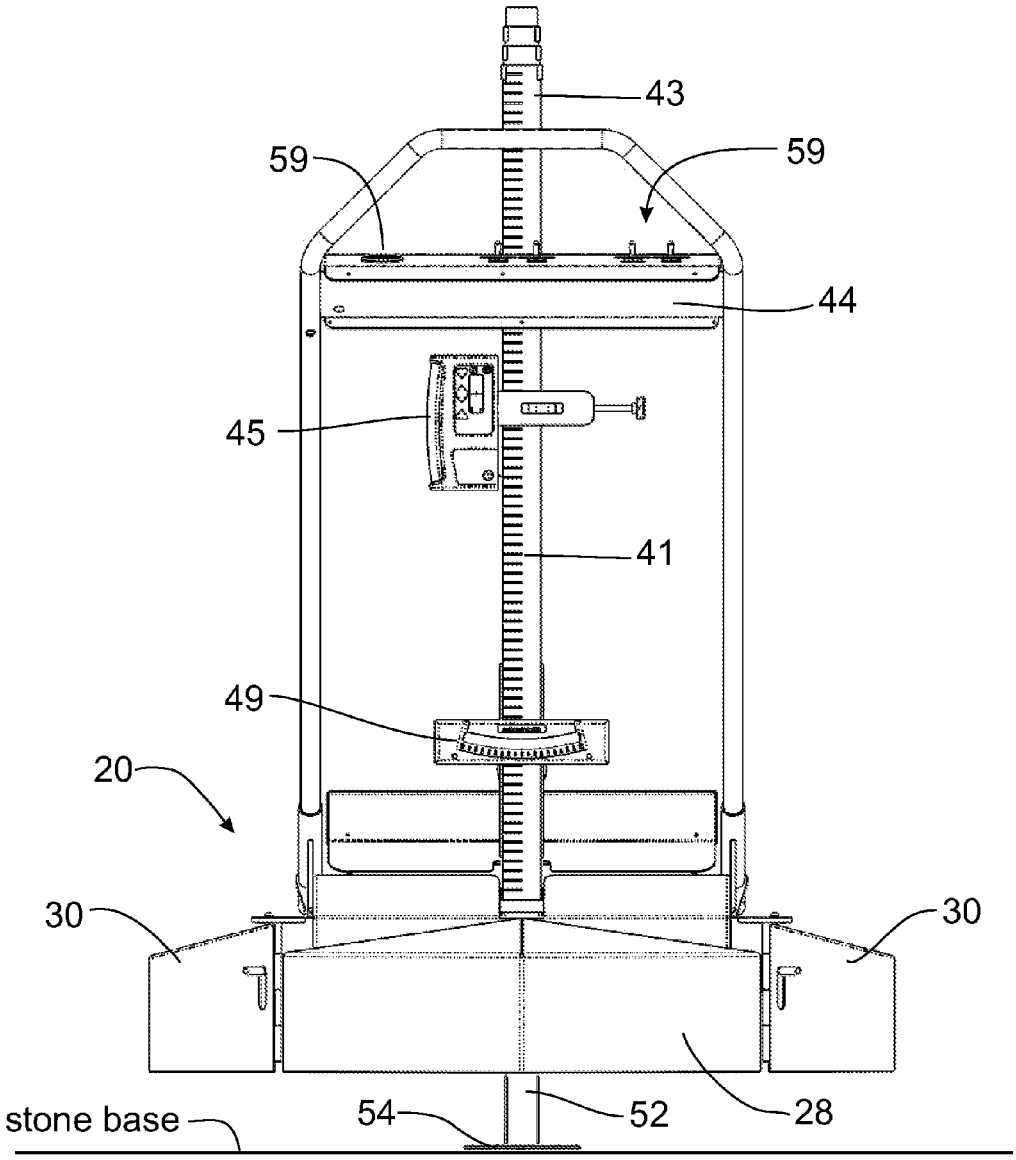
FIG. 13 is a front elevational view of the screed machine shown in FIG. 12.
Figure 14:
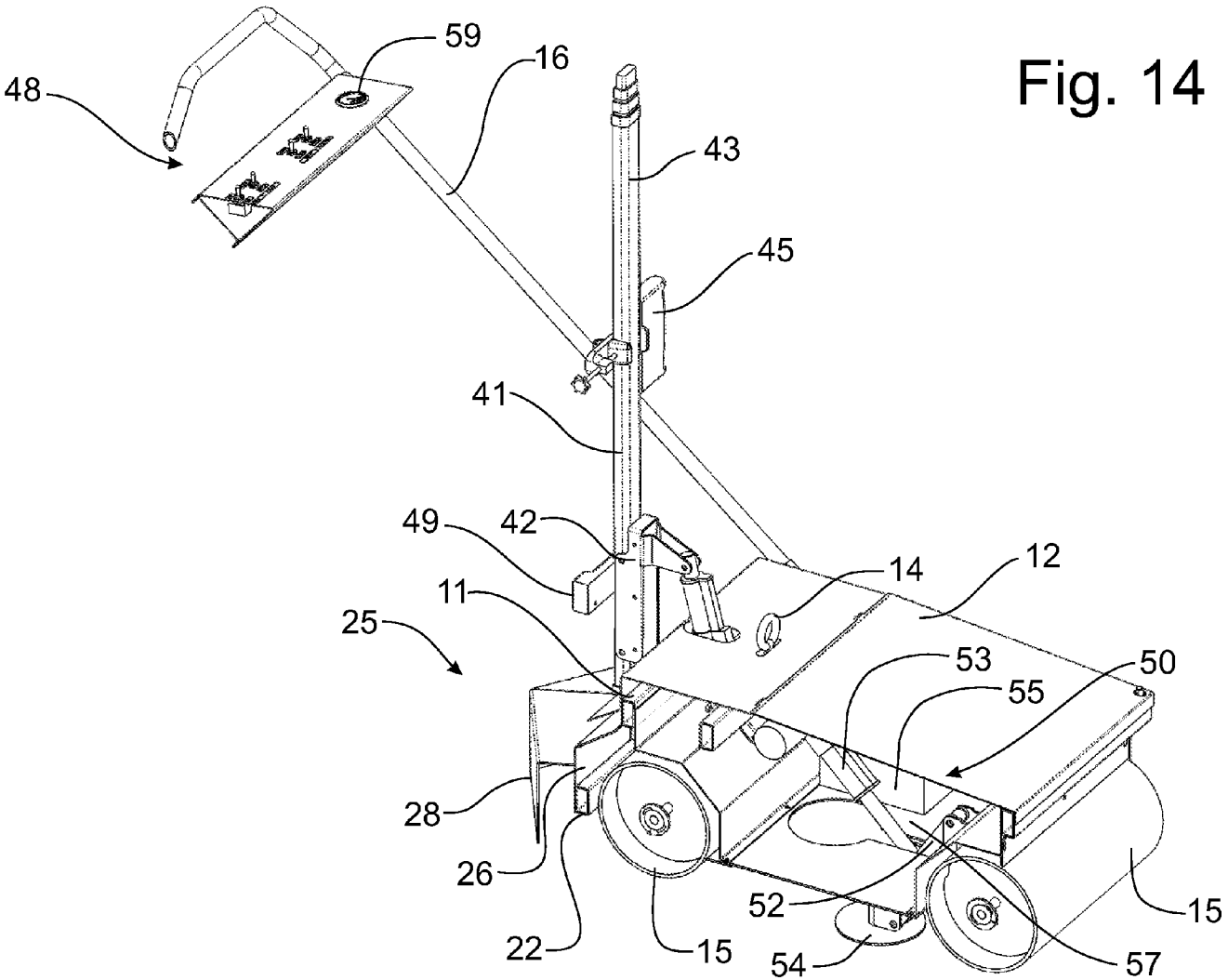
FIG. 14 is a cross-sectional perspective view of the left side of the screed machine taken along lines 14-14 of FIG. 9.
Figure 15:
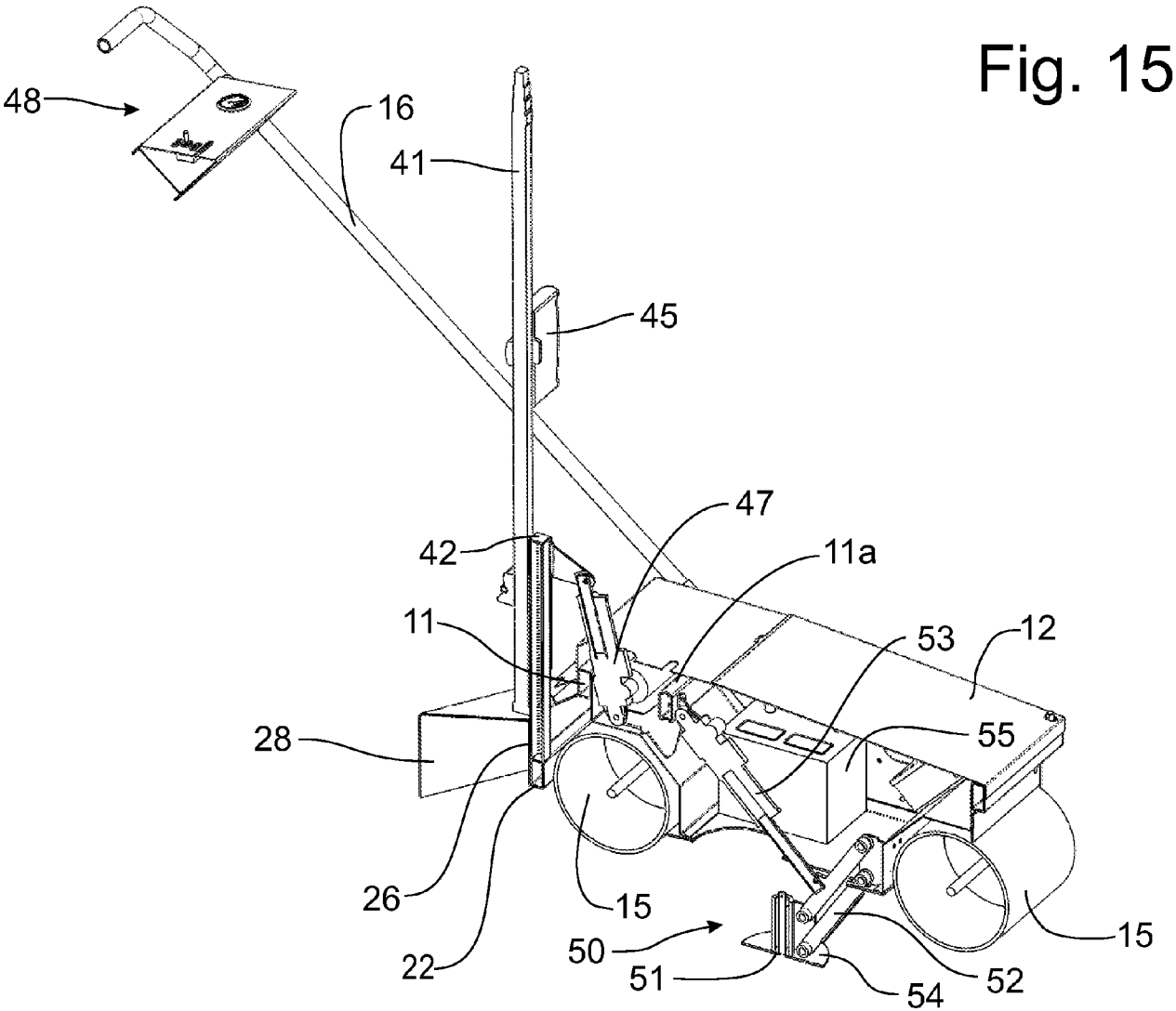
FIG. 15 is a cross-section perspective view near the center of the screed machine taken along lines 15-15 of FIG. 10.
Figure 16:
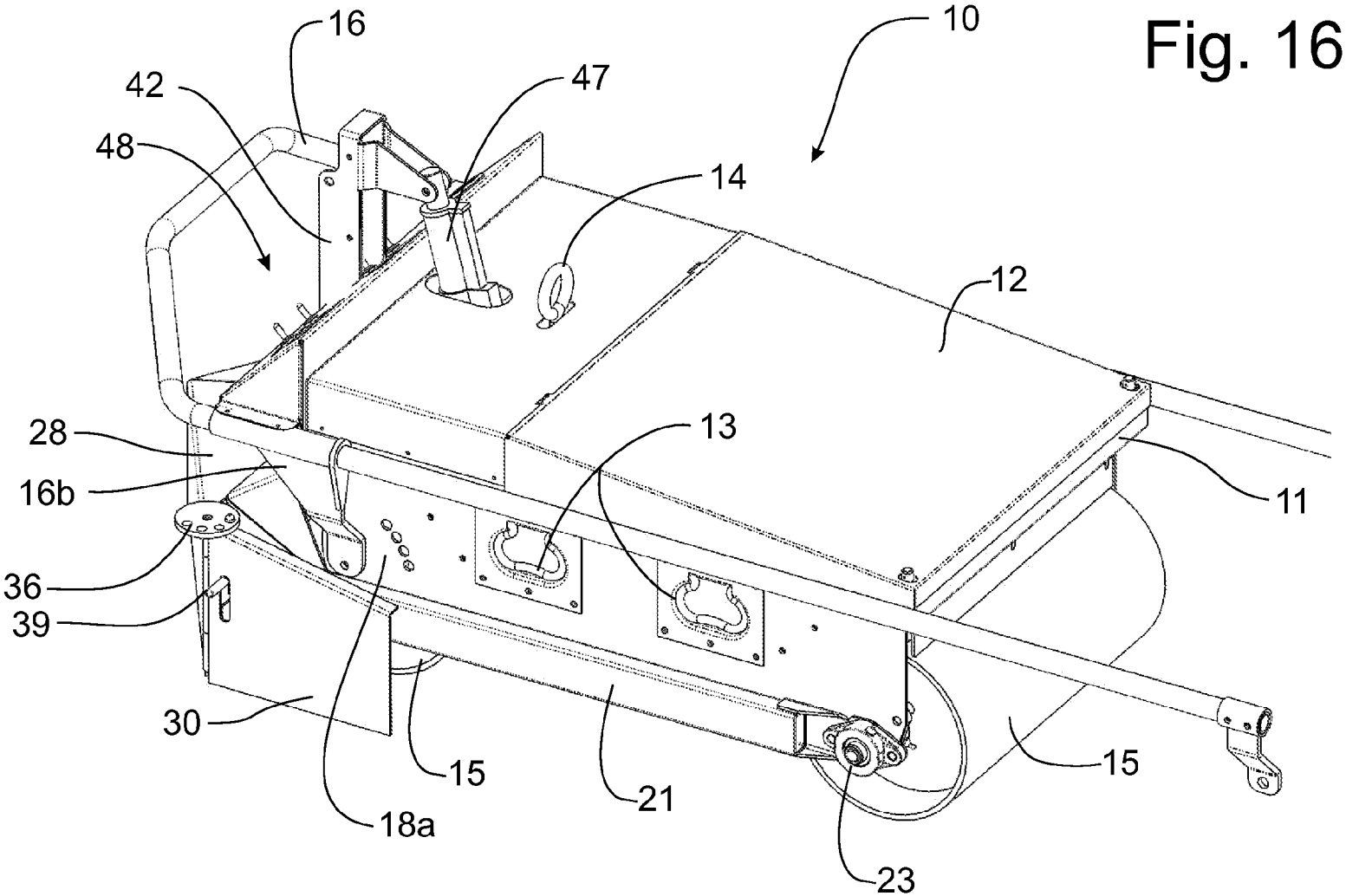
FIG. 16 is a perspective view of the screed machine collapsed into a compact transport orientation.

The handle assembly 16 is mounted at the front end of the main frame 11 and projects forwardly to be grasped to pull the machine 10 over the surface of the stone base. The handle assembly 16 is preferably pivotally attached to the main frame 11 by pivots 17. The handle assembly 16 can be formed with a U-shaped handle 16*a* that terminates in a mounting leg 16*b* that is oriented orthogonally to the handle 16*a*. The mounting legs 16*b* are connected to the pivots 17 so that the height of the handle 16*a* can be varied to the preference of the operator. As best seen in FIGS. 3 and 11, the handle assembly 16 also includes a pivot control device 18, including an apertured plate 18*a* affixed to the main frame 11 and a pivot lock 19 that is engagable with a selected one of the apertures in the plate 18*a* to lock the handle 16*a* in a selected height.

A screed assembly 20 is pivotally mounted on the main frame 11 and is positioned in front of the main frame 11 to engage the top surface of the stone base to level the stone base. The screed assembly 20 includes a U-shaped support frame 21 pivotally connected to the main frame 11 at pivots 23 located approximately centrally on the main frame 11 to give the pivotal movement of the screed assembly 20 an arc that is substantially linear forwardly of the main frame 11. The support frame 21 has mounted thereon a screed member 25 that includes a rearward linear portion 26 extending transversely across the entire front of the machine 10 and projecting outboard of the main frame 11 to either side thereof. The screed member 25 also includes a V-shaped wedge portion 28 mounted to the front of the linear portion 26 to provide a screed member 25 that has longitudinal depth and operates to move excess stone outboard of the surface being leveled by the machine 10.

The screed assembly 30 also includes a pair of laterally spaced side extension wings 30 positioned at each respective outboard end of the linear portion 26 of the screed member 25. Each side extension wing 30 is pivotally connected to the respective end of the linear portion 26 by a vertical hinge 32 to permit the side extension wing 30 to move between a retracted, inoperative position seen in FIGS. 4, 7 and 9, and an extended operative position seen in FIGS. 1, 2, 5, 6, 8, 10 and 11. The movement of the side extension wings 30 is best seen in comparison of FIGS. 4 and 5, and in comparison of FIGS. 7 and 8, and also FIGS. 9 and 10. A position control apparatus 35 is operable to lock each of the side extension wings in a selected pivoted position.

An apertured plate 36 mounted on top of the vertical hinge 32 is engaged by a spring-loaded pivot lock 38 having a perpendicularly extending actuation lever 39. With the spring-loaded pivot lock 38 retracted, the side extension wing 30 can be pivoted to the desired position and the actuation lever released to engage the pivot lock 38 with one of the holes in the plate 36 to lock the side extension wing 30 in position. The movement of the side extension wings 30 into an operative position expands the transverse width of the surface of the stone base being leveled by the screed assembly 20, which will provide room for the machine 10 to make a turn, as will be described in greater detail below.

The screed assembly 20 is pivotally movable to cause a vertical adjustment of the screed member 25 by a screed control mechanism 40. A mast 41 is mounted on the transverse support frame member 22 to be vertically movable therewith. The mast 41 preferably includes a base member 42 and an extendable top mast member 43 supported by the base member 42 which is attached to the transverse support frame member 22. A laser receiver 45 is connected to the top mast member 43 by an adjustable mounting apparatus 46 that permits the laser receiver 45 to be positioned vertically along the top mast member 43. An electrically powered linear actuator 47 is mounted on the main frame 11 and operatively connected to the base member 42. The linear actuator 47 is operatively coupled to the laser receiver 45 through a controller 48 that incorporates switches for automatic control of the screed member 25 and manual control thereof.

When in the automatic control mode, the controller 48 receives a signal from the laser receiver 45 that the laser receiver 45 is moving up and/or down with respect to a laser level signal (not shown). The controller 48 activates the linear actuator 47 to cause the linear actuator 47 to expand or contract, as appropriate, to move the mast member 41 and, thus, the screed member 25, thereby keeping the screed member 25 at a level orientation as the machine 10 is moved across the top surface of the stone base. The support panel 44, on which the control mechanism 48 is mounted, is preferably mounted on the handle 16 for convenient access by the operator. The control mechanism 48 is also provided with a sight level 49 that indicates the level of the machine 10 in a transverse direction. One skilled in the art will recognize that electrical wires for the control mechanism and related electrically powered components are removed from the drawings for purposes of clarity, although some components, such as the operative connection between the laser receiver 45 and the control mechanism 48 may be wireless.

An electrically powered jack 50 is mounted on the frame 11, preferably the transverse cross member 11*a*. The jack 50 has a pivotable linkage member 52, configured as a four-bar linkage, to permit the bottom plate assembly 51 to remain in a vertical orientation. The bottom plate assembly 51 includes a bottom plate member 54 that is rotatable relative to the remainder of the assembly 51. The pivotable member 52 is operatively connected to an electrical jack actuator 53 that upon extension and contraction effects vertical movement of the linkage member 52. The bottom plate 52 at the terminus of the linkage member 52 can swivel relative to the linkage member 52 on which it is mounted. As is represented in FIGS. 12-15, the extension of the linkage member 52 presses the bottom plate 54 onto the stone base and raises of the screed machine 10 above the surface of the stone base. The swiveling bottom plate 54, on which the weight of the machine 10 is supported on the stone base, allows the entire machine 10 to be rotated and, thus, affect a turn of the machine 10 to be movable in a different direction. Once the machine 10 is reoriented, the linkage member 52 is retracted and the screed machine 10 is free to operate in the new direction.

Power for the electrically operated components, such as the linear actuator 47, the control mechanism 48 and the jack actuator 53, is provided by a 12-volt marine battery 55 supported on a battery support pan 57 mounted on the main frame 11 between the rollers 15. The battery support pan 57 is positioned higher than the rollers 15 and, thus, will not contact the stone base. The support panel 44 has mounted thereon a battery life gauge 59 operably connected to the battery 55 to provide a visual indication of the amount of electrical power remaining in the battery 55. The battery 55 is preferably rechargeable.

The screed machine 10 operates in conjunction with a laser level (not shown) that is set up on site and emits a laser signal to indicate the proper grade of the stone base being prepared. In the case of a stone base to be prepared for a pre-cast concrete wall, the laser level emits a laser signal that indicates a level grade at a given elevation. In the case of a sewer line that is placed on a slope gradient, the laser level emits a laser signal that is indicative of that slope gradient. The laser signal is received by the laser receiver 45 that must be positioned on the top mast member 43 by manipulating the mounting apparatus 46. The screed machine 10 is then placed on the stone base at a position corresponding to the desired elevation of the prepared stone base in an orientation that will coordinate the movement of the screed machine 10 with the alignment of the position of structure to be erected on the stone base, typically by a crane or a powered lift that is connected to the crane hoist member 14 to lower the screed machine 10 into the excavation where the stone base has been placed.

The screed machine 10 has the jack 50 retracted and preferably has the side extension wings 30 retracted into the inoperative position and locked into place with the position control apparatus 35. The transverse orientation of the screed machine 10 must be level, which can be authenticated by observing the pendulum 49. If the sight level 49 indicates that the screed machine 10 is not level, the stone base at which the screed machine 10 is to start operation must be manually leveled so that the screed machine 10 starts operation in a transversely level orientation. The screed control mechanism 40 is powered on and switched into the automatic mode of operation. The screed machine 10 is then ready for movement along the path corresponding to the location at which the structure, which in this example would be a pre-cast concrete wall, would subsequently be erected.

Operation of the screed machine 10 is preferably accomplished by two people. One person grasps the handle 16*a*, which can be pivotally positioned through manipulation of the position control device 18 to locate the handle 16*a* at a convenient height, and pulls the screed machine along the desired path. The second person utilizes a shovel to assure that a supply of the stone base is piled in front of the wedge portion 28 of the screed member 25 entirely across the transverse width of the screed member 25. If the screed machine 10 is moved and operated without a supply of stone base in front of the screed member 25, the screed member 25 can leave a section of the path of the stone base below the desired grade. If the supply of the stone base in front of the screed member 25 is too great, the screed machine 10 will be more difficult to pull along the desired path. Accordingly, the stone base needs to be rough graded to within about an inch or so of the desired final grade before the screed machine 10 is utilized.

As the first person pulls on the handle assembly 16, the screed machine 10 is dragged along the desired path of the stone base that is to be finally graded. The laser signal received by the laser receiver 45 identifies the elevation along which the laser receiver 45 is to travel. As the laser receiver 45 moves up or down outside of a predetermined range, corresponding to the screed member 25 changing elevation, electrical power is directed to the linear actuator 47 by the control mechanism 48 to cause the base 42 of the mast 41 to be raised or lowered accordingly. As a result, the screed member 25, which is connected to the base 42 of the mast 41 moves vertically to keep the position of the screed member 25 at the desired elevation. The depth of the screed member 25 from the wedge portion 28 to the linear portion 26 keeps the stone base level without ridges and valleys caused by the vertical adjustment of the screed member 25 through operation of the control mechanism 48.

When the screed machine 25 approaches a corner on the desired path along which the stone base is to be finally graded, it is desirable to widen the transverse width of the path being graded on the stone base to affect the turn at the corner, as will be described in greater detail below. To increase the transverse width of the graded path, the operator needs to depress the actuation lever 39 on the side extension wing 30 corresponding to the inside of the turn to be made so that the side extension wing 30 can be rotated outwardly into an appropriate operative position, whereupon the actuation lever 39 can be released and the side extension wing 30 locked into place. Because the bottom edge of the side extension wings 30 are co-planar with the linear portion 26 and wedge portion 28 of the screed member 25, the side extension wing 30 simply widens the path being graded by the screed machine 10.

One skilled in the art will recognize that the side extension wings 30 increase the drag on the screed member 25 and, therefore, increases the force required to move the screed machine 10. If additional assistance is required to move the screed machine 10 along the path being graded, the other person, or persons, helping the operator can grasp the grips 13 and assist in pushing the screed machine 10. At the turn, the screed machine 10 is moved along the path to be graded until the distal tip of the side extension wing 30 that has been deployed into the operative position has cleared the path to be graded after the turn.

When the screed machine 10 has been moved to a position where the deployed side extension wing 30 the location of the jack 50 is at or near the center of the new path on the stone base to be graded after the turn. The operator deactivates the control mechanism 48 by either turning the control mechanism 48 off or switching the control mechanism 48 into manual mode, and then activates the actuator 53 to extend the jack 50 and engage the bottom plate 54 on the graded surface of the stone base immediately below the screed machine 10. Continued extension of the jack 50 will raise the screed machine 10, as is reflected in FIGS. 12 and 13. Balance of the machine 10 is maintained because the jack 50 is located at the center of gravity of the machine 10 and also by the operator holding the handle 16.

Once elevated off of the stone base, the machine 10 can be pivoted about the vertical axis defined by the bottom plate assembly 51 due to the swiveled bottom plate 54. Accordingly, the screed machine 10 can be aligned on the next path to be graded. The extra transverse width of the screed member 25 provided by the extension of the wing 30 graded off a sufficient portion of this next path that the entire screed machine 10 will be placed on a leveled surface to start operation along this next path to be graded. When the screed machine 10 is properly aligned on the next path, the side extension wing(s) 30 are repositioned to the inoperative position and the jack 50 is retracted to place the rollers 15 and the screed member 25 back onto the stone base. The control mechanism 48 can then be switched back to the automatic mode and the screed machine 10 can be pulled along this next path as described above until reaching the next turn.

When finished, the entire perimeter on the stone base corresponding to the erection of the pre-cast concrete walls into a foundation will be graded to a level elevation as defined by the laser level and the paths on the stone base compacted by the weight of the screed machine 10 exerted on the rollers 15. The pre-cast concrete walls can be erected on the graded paths with full support from the graded stone base. Similarly, the screed machine 10 can be used to grade and compact the stone base for a sewer line, the primary difference being that the laser level will be set on the slope gradient for the sewer line and the automatic function of the control mechanism 48 will properly adjust the screed machine to grade the stone base along the desired slope gradient.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiments of the invention; however, concepts, as based upon the description, may be employed in other embodiments without departing from the scope of the invention.

Having thus described the invention, what is claimed:

1. A screed machine for leveling a stone base, comprising:

a frame supported for movement over said stone base;

a screed assembly extending forwardly from said frame to engage said stone base, said screed assembly including a wedge portion to direct stone base material laterally to opposing sides of said frame, said screed assembly being supported on said frame for vertical movement relative to said frame, said screed assembly further including a mast projecting upwardly therefrom;

a receiver mounted on said mast to receive a signal indicative of a desired final grade on said stone base;

a jack supported on said frame and being vertically movable from said frame to engage said stone base and elevate said frame and said rollers above the stone base, said jack being located at the center of gravity of said screed machine to permit said screed machine to be balanced on said jack so that said frame can be rotated about a generally vertical axis defined by said jack to effect a redirection of said rollers;

an actuator interconnecting said frame and said screed assembly to affect vertical movement of said screed assembly in response to said signal; and compaction apparatus mounted on said frame rearwardly of said screed assembly to compact said stone base after being leveled by said screed assembly.

2. The screed machine of claim 1 wherein said compaction apparatus includes a pair of transversely extending longitudinally spaced rollers supporting said frame for movement over said stone base.

3. The screed machine of claim 2 wherein said screed assembly further includes a pair of wing members pivotally mounted on said wedge member on opposing sides thereof for movement about a generally vertical axis, said wing members being selectively positionable at selected angular orientations by a pivot control mechanism.

4. The screed machine of claim 3 wherein said screed assembly includes a subframe pivotally connected to said frame, said mast being attached to said subframe to be movable therewith.

5. The screed machine of claim 4 wherein said subframe includes a pair of rearwardly extending arms, each said arm carrying a pivot connected to said frame.

6. The screed machine of claim 1 wherein said jack includes a pivoted linkage member terminating in a bottom plate mounted by a swivel to said linkage member, said screed machine being rotatable on said bottom plate to permit rotation of said screed machine when said bottom plate is engaged with said stone base and said frame and said rollers are elevated above said stone base.

7. The screed machine of claim 6 wherein the movement of said linkage member of said jack is powered by an actuator.

8. The screed machine of claim 3 wherein said frame includes a handle extending forwardly of said screed assembly for engagement by an operator to pull said screed machine over said stone base.

9. The screed machine of claim 2 further comprising a sight level mounted on said frame for transverse swinging movement to provide an indication of a transverse orientation of said frame.

10. A screed machine for leveling a stone base, comprising:

a frame supported for movement over said stone base by rollers rotatable about respective transverse axes, said rollers being spaced longitudinally;

a screed assembly extending forwardly from said frame to engage said stone base, said screed assembly including a subframe supporting a wedge portion to direct stone base material laterally to opposing sides of said frame and a mast extending upwardly from said subframe, said subframe being connected to said frame for vertical movement relative thereto;

a receiver mounted on said mast to receive a signal indicative of a desired final grade on said stone base;

an actuator interconnecting said frame and said mast to affect vertical movement of said screed assembly;

control mechanism operably connected to said receiver and to said actuator to cause operation of said actuator in response to the receipt of said signal such that said screed assembly is positioned to cause said stone base to be graded to said final grade; and a jack supported on said frame and being vertically movable from said frame to engage said stone base and elevate said frame and said rollers above the stone base, said jack including a pivoted linkage member terminating in a bottom plate which is rotatable relative to said linkage member to allow said frame and said rollers to be rotated to a new direction while elevated above the surface of said stone base.

11. The screed machine of claim 10 wherein said screed assembly further includes a pair of wing members pivotally mounted on said wedge member on opposing sides thereof for movement about respective generally vertical axes, said wing members being selectively positionable at selected angular orientations by a pivot control mechanism.

12. The screed machine of claim 10 wherein said subframe includes a pair of rearwardly extending arms, each said arm carrying a pivot connected to said frame.

13. The screed machine of claim 10 wherein the vertical movement of said linkage member of said jack is powered by an actuator operably connected to said control mechanism.

14. A method of grading a stone base to provide a level surface at a final grade for the installation of pre-cast concrete wall panels on said stone base, comprising the steps of:

rough grading said stone base to a rough grade that is close in elevation to said final grade;

positioning a screed machine onto a predetermined path on said stone base corresponding to a location for a subsequent installation of at least one of said pre-cast concrete wall panels, said screen machine including:

a frame supported on elongated, transversely extending and longitudinally spaced rollers for movement over said stone base;

a screed assembly mounted on said frame and projecting forwardly of said frame to grade said stone base, said screed assembly being vertically movable relative to said frame;

a receiver mounted on a mast connected to said screed assembly to receive a signal indicative of said final grade; and control mechanism operably interconnecting said frame and said screed assembly to cause vertical movement of said screed assembly in response to the receipt of said signal;

generating a signal indicative of said final grade for receipt by said receiver;

moving said screed machine along said predetermined path;

adjusting the vertical position of said screed assembly in response to the receipt of said signal indicative of said final grade;

compacting said stone base along said predetermined path after said screed assembly has graded said predetermined path of said stone base by said rollers; and turning said screed machine at an intersection of two intersecting paths corresponding to lines along which said pre-cast concrete wall panels are to be installed, said turning step including the steps of:

extending a linkage member of said jack from said frame to engage a bottom plate member, mounted on the distal end of said linkage member by a swivel, with said stone base and elevate said frame and said rollers above said stone base;

balancing said frame and said rollers on said jack while elevated above the stone base; and pivoting said frame and said rollers about a generally vertical axis corresponding to said bottom plate member by rotating said linkage member relative to said bottom plate until said rollers are aligned to allow movement along said second predetermined path.

15. The method of claim 14 wherein adjusting step includes the step of pivoting said screed member about a pivotal connection of said screed member to said frame.

* * * * *